US010760439B2

(12) United States Patent
Morisot et al.

(10) Patent No.: US 10,760,439 B2
(45) Date of Patent: Sep. 1, 2020

(54) METHOD OF TESTING THE INTEGRITY OF A FLUID FLOW REGULATOR SYSTEM FOR A TURBINE ENGINE

(71) Applicant: SAFRAN AIRCRAFT ENGINES, Paris (FR)

(72) Inventors: Clementine Morisot, Moissy-Cramayel (FR); Benoit Michel Pontallier, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 74 days.

(21) Appl. No.: 16/310,648

(22) PCT Filed: Jun. 8, 2017

(86) PCT No.: PCT/FR2017/051449

§ 371 (c)(1),
(2) Date: Dec. 17, 2018

(87) PCT Pub. No.: WO2017/220881

PCT Pub. Date: Dec. 28, 2017

(65) Prior Publication Data

US 2019/0323369 A1 Oct. 24, 2019

(30) Foreign Application Priority Data

Jun. 20, 2016 (FR) ..... 16 55704

(51) Int. Cl.
*F01D 17/12* (2006.01)
*F01D 9/06* (2006.01)
*F01D 17/10* (2006.01)

(52) U.S. Cl.
CPC ..... *F01D 9/06* (2013.01); *F01D 17/10* (2013.01); *F05D 2260/52* (2013.01); *F05D 2260/80* (2013.01); *F05D 2260/83* (2013.01)

(58) Field of Classification Search
CPC .... F01D 17/105; F01D 17/141; F01D 17/143; F01D 21/003; F05D 2260/606; F05D 2260/80; F05D 2260/226; F05D 2260/83
See application file for complete search history.

(56) References Cited

U.S. PATENT DOCUMENTS 4,086,761 A * 5/1978 Schaut ..... F02C 7/045 60/226.1
5,463,865 A 11/1995 Smith
(Continued)

FOREIGN PATENT DOCUMENTS

FR 1.399.565 5/1965

OTHER PUBLICATIONS

International Search Report dated Sep. 8, 2017 in PCT/FR2017/051449 filed Jun. 8, 2017.

*Primary Examiner* — Ninh H. Nguyen
(74) *Attorney, Agent, or Firm* — Oblon, McClelland, Maier & Neustadt, L.L.P.

(57) ABSTRACT

A method of testing the integrity of a fluid flow regulator system for a turbine engine, the system including a fluid-passing duct associated with a movable flap; an actuator having a movable drive element suitable for delivering a movement force between a first position corresponding to the closed position of the movable flap and a second position corresponding to the open position of the movable flap; a push-pull cable interconnecting the drive element and the movable flap; and return device exerting a return force for moving the flap; the method of testing the integrity of the system including in succession: a step of supplying power to the actuator in order to place the drive element in the second position; a step of interrupting the supply of power; and a step of measuring the position of the drive element.

11 Claims, 4 Drawing Sheets

(56) References Cited

U.S. PATENT DOCUMENTS

| | | | | |
|---|---|---|---|---|
| 6,557,400 | B2 * | 5/2003 | Xiong | F01D 17/105<br>701/100 |
| 7,328,098 | B1 * | 2/2008 | VanderLeest | F02C 9/18<br>60/785 |
| 9,441,568 | B2 * | 9/2016 | Ossareh | F02D 41/0007 |

* cited by examiner

METHOD OF TESTING THE INTEGRITY OF A FLUID FLOW REGULATOR SYSTEM FOR A TURBINE ENGINE

BACKGROUND OF THE INVENTION

The invention relates to the field of detecting failures of mechanical elements in a fluid flow regulator system for a fluid-passing duct in a turbine engine. More precisely, the invention relates to a method of testing integrity in a fluid flow regulator system for a turbine engine.

A particular application of such a fluid flow regulator system, when the fluid is air bled from an air passage in the turbine engine, relates to managing the radial clearance between a rotor and a stator of a turbine in the turbine engine, e.g. between rotor blades and a stator ring surrounding the blades. This management is particularly important for controlling the performance of the turbine engine, in particular for controlling its efficiency and its maximum thrust. In order to control this radial clearance, it is known to make use of a circuit for cooling the stator by bleeding air from the flow passage for the secondary stream through a bypass turbine engine. Advantageously, the rate at which air is bled from the air stream is regulated and, by cooling the stator, it serves to control expansion of the stator, and thus to control its radial clearance relative to the rotor.

For a bypass turbine engine, a first known method consists in using a scoop to act passively to bleed off a portion of the air stream in the flow passage for the secondary stream, and then to regulate the flow rate of the air stream that has been bled off by means of a flow regulator valve inserted in the air bleed circuit. By way of example, one such solution is described in Document FR 2 614 073. The main drawback of that solution lies in the fact that installing an open scoop in the flow passage for the secondary stream gives rise to large head losses.

In order to mitigate that problem, and thereby improve the performance of the turbine engine, it is known to form a scoop in a services-passing arm that extends across the flow passage of the secondary stream, with the scoop then bleeding off an air stream actively from the flow passage for the secondary stream. Under such circumstances, the scoop is active in the sense that it is associated with a flap that is pivotable between an open position and a closed position, thereby enabling the flow rate of air that enters the scoop to be regulated as a function of the position of the flap. By way of example, one such solution is described in Document FR 3 025 843.

The movable flap of that scoop is commonly opened using an actuation force that results from moving a drive rod of an actuator. The actuation force is transmitted to the movable flap via a push-pull cable, thereby serving to control movement of the movable flap. The actuation rod is moved when the actuator is powered, the power supply to the actuator being controlled by an electronic computer. In the event of the computer detecting a problem, it can then cause the power supply to the actuator to be stopped, thereby stopping any opening of the movable flap of the scoop.

Furthermore, the scoop includes safety return means in the form of a spring serving, in the absence of any actuation force being transmitted by the cable to the movable flap, to bring the movable flap into its closed position, which position corresponds to a safe position for the movable flap of the scoop, commonly referred to as its "fail-safe" position.

For reasons of accessibility, in particular concerning temperature, the electronic computer uses closed loop regulation only for the movement of the drive rod of the electrical actuator. Such regulation is performed on the basis of measurements delivered by a position sensor that measures the successive positions of the drive rod of the actuator. The opening of the movable flap of the scoop is then correlated by the electronic computer as a function of the position of the drive rod of the actuator.

A major drawback involved in implementing such a solution then occurs whenever there is a break in the safety return spring or in the cable making the connection between the drive rod of the actuator and the movable flap. If it is the spring that breaks, it is no longer possible to ensure that the movable flap of the scoop will take up its fail-safe position in the event of a failure of the power supply to the actuator. If it is the cable that breaks, the actuator can no longer transmit its actuation force to the movable flap and thereby open it.

In the above-mentioned situations, the drive rod of the actuator nevertheless continues to be movable and its movement continues to be measurable by the position sensor. Since the physical states of the cable and of the safety spring are not supervised by the electronic computer, it can therefore not detect that the spring or the push-pull cable has broken, and consequently it will assume that the operation of the air flow regulator system is nominal, even when that is not so.

Such situations are therefore dormant. In addition, their impact cannot be observed in the short term on the engine itself. Specifically, it is then difficult to observe degraded performance or wear in mechanical parts. Consequently, breakage of the spring or of the push-pull cable can remain dormant during a large number of cycles and, in the longer term, can lead to irreversible degradation of the engine, e.g. excessive wear of abradable surfaces or a reduction in the lifetime of the casing of the low-pressure turbine.

An analysis of failure trees in order to identify the cause of such degradations cannot allow the presence of dormant contributors, particularly if such failures may occur at a potentially large rate. Specifically, the persistence of dormancy for the above-mentioned failures greatly limits the viability of air flow regulator systems that make use of scoops of that type.

OBJECT AND SUMMARY OF THE INVENTION

An object of the present invention is to remedy the above-mentioned drawbacks. More precisely, the present invention seeks to propose a solution that makes it possible in general manner to detect failures due to a broken push-pull cable or to an inability of the safety return means of a fluid flow regulator system that includes a fluid flow duct associated with a movable flap.

To this end, the invention provides a method of testing the integrity of a fluid flow regulator system for a turbine engine, the system comprising:

- a fluid-passing duct associated with a movable flap for shutting the duct and suitable for pivoting about an axis between a closed position and an open position;
- an actuator having a movable drive element, said drive element being suitable for delivering a movement force between a first position corresponding to the closed position of the movable flap and a second position corresponding to the open position of the movable flap;
- a push-pull cable interconnecting the drive element of the actuator and the movable flap, and suitable for transmitting a movement force to the movable flap; and safety return means exerting a return force suitable for moving the movable flap towards the closed position in the absence of force being transmitted by the cable to the movable flap;

said method of testing the integrity of the system comprising in succession:

a step of supplying power to the actuator in order to place the drive element in the second position;

a step of interrupting the supply of power to the actuator; and a step of measuring the position of the drive element.

Advantageously, as a function of the result of the measurement step, it is possible to determine whether or not there is a problem of integrity in the air flow regulator system. Furthermore, the method is applicable to any system for regulating airflow in a turbine engine and presenting the above-described architecture. The performance of such a method can be executed in a predetermined number of cycles, making it possible to detect any potential dormant fault due to breakage of the safety spring or of the push-pull cable. Consequently, this makes it possible to take appropriate action, e.g. accommodating to any detected failures in order to prevent degradation of the turbine engine. This serves to lengthen the lifetime of the engine.

In an aspect, the method comprises:

comparing the measured position of the drive element with said second position in order to identify a movement of the drive element; and detecting an inability of the safety return means or breakage of the push-pull cable when the measured position of the drive element corresponds to said second position.

In another aspect, after deducing the inability of the safety return means or the breakage of the push-pull cable, the method comprises supplying power to the actuator in order to place the drive element in said first position.

In another aspect, the method comprises:

comparing the measured position of the drive element with said second position; and deducing integrity of the regulator system when the measured position differs from said second position.

In another aspect, after deducing integrity of the regulator system, the method comprises:

comparing the measured position of the actuator element with said first position; and when the position of the drive element differs from said first position:

redefining the first position by allocating the measured position of the drive element to the first position; and as a function of the redefined first position, reconfiguring a pre-stored control relationship relating to the movement of the drive element.

The invention also provides a fluid flow regulator system for a turbine engine, the system comprising:

a fluid-passing duct associated with a movable flap for shutting the duct and suitable for pivoting about an axis between a closed position and an open position;

an actuator having a movable drive element, said drive element being suitable for delivering a movement force between a first position corresponding to the closed position of the movable flap and a second position corresponding to the open position of the movable flap;

an electronic computer suitable for:

supplying power to the actuator so as to cause its drive element to be moved; and estimating the movement of the drive element from measurements returned by at least one position sensor measuring the position of that element;

a push-pull cable interconnecting the drive element of the actuator and the movable flap and suitable for transmitting a movement force to the movable flap; and safety return means exerting a return force suitable for moving the movable flap towards the closed position in the absence of force being transmitted by the cable to the movable flap;

the computer being configured to proceed with a test of the integrity of the system by causing the following in succession:

power to be supplied to the actuator to place the drive element in the second position;

interrupting the power supply to the actuator; and measuring the position of the drive element.

In an aspect of the system, the electronic computer is configured:

to compare the measurement of the position of the drive element with said second position in order to identify a movement of the drive element; and to detect an inability of the safety return means or a breakage of the push-pull cable when the measured position of the drive element corresponds to said second position.

In another aspect of the system, after deducing the inability of the safety return means or the breakage of the push-pull cable, the electronic computer is configured to supply power to the actuator so as to place the drive element in said first position.

In another aspect of the system, the electronic computer is configured:

to compare the measured position of the drive element with said second position; and to deduce the integrity of the regulator system when the measured position differs from said second position.

In another aspect of the system, the computer is configured;

after deducing integrity of the regulator system, to compare the measured position of the actuator element with said first position; and when the position of the drive element differs from said first position:

to redefine the first position by allocating the measured position of the drive element to the first position; and as a function of the redefined first position, to reconfigure a pre-stored control relationship relating to the movement of the drive element.

In another aspect, the regulator system comprises:

an air bleed scoop constituting said fluid-passing duct; and a mechanical spring constituting said safety return means and potentially suffering a break leading to its inability to produce said return force exerted on the movable flap.

BRIEF DESCRIPTION OF THE DRAWINGS

Other characteristics and advantages of the invention appear from the following description of particular implementations of the invention, given as non-limiting examples, and with reference to the accompanying drawings, in which.

DETAILED DESCRIPTION OF IMPLEMENTATIONS

The terms "upstream" and "downstream" are used below relative to the flow direction of gas through the turbine engine.

Figure 1:
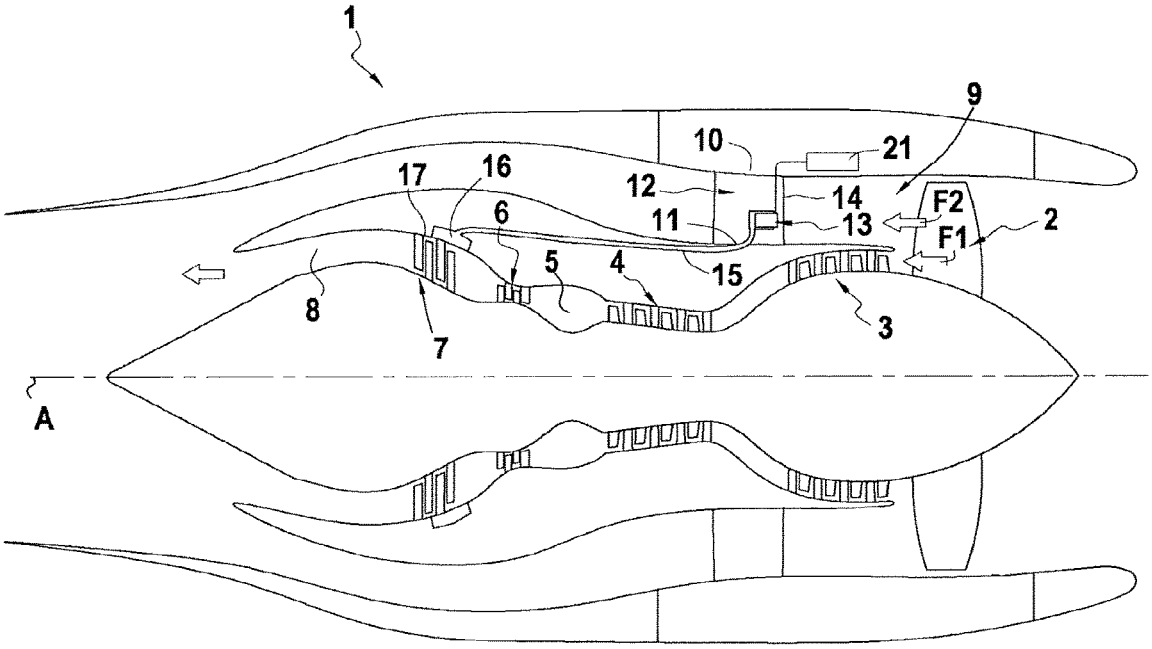
FIG. 1 is a diagrammatic longitudinal section view of a turbine engine including an embodiment of an air flow regulator system.

FIG. 1 shows a bypass turbine engine comprising in conventional manner from upstream to downstream in succession: at least one fan 2; an engine portion comprising in succession at least one low-pressure compressor stage 3 and at least one high-pressure compressor stage 4; a combustion chamber 5; at least one high-pressure turbine stage 6 and at least one low-pressure turbine stage 7; together with an exhaust nozzle 8 for the primary stream F1, i.e. the gas flowing in the primary passage.

Rotors, rotating about the main axis A of the turbine engine and potentially coupled together by various transmission and gearing systems, correspond to these various elements.

The air stream driven by the fans is split into a portion F1 entering the primary circuit that corresponds to the engine proper and a secondary stream portion F2 that contributes most of the thrust delivered by the turbine engine.

The secondary stream F2 passes around the engine portion via a secondary passage 9.

In general, a turbine engine has at least one system for passing services such as air ducts, oil ducts, electric cables, so as to enable them to cross a passage, such as the flow passage 9 for the secondary stream F2, while minimizing disturbances to the flow. The services serve to connect first equipment situated radially inside the passage with second equipment situated radially outside the passage 9, where the term "radially" should be understood relative to the main axis A of the turbine engine.

A services-passing system as shown in the secondary passage 9 in FIG. 1 generally comprises an annular body having two coaxial annular shrouds, respectively an inner shroud 10 and an outer shroud 11. These two shrouds are connected together by arms 12 that are substantially radial and tubular and that include internal passages for passing services. The system may be mounted downstream from an intermediate casing of the turbine engine, with the shrouds 10 and 11 providing continuity for the walls of the passage 9 where the services-passing system passes through.

Generally, the arms 12 of the services-passing system are streamlined and aligned in the flow direction of the main air stream F2 in the passage 9 so as to limit disturbances to that stream and reduce head losses. Radial stator vanes may be installed upstream, e.g. guide vanes. Under such circumstances, the arms of the services-passing system extend downstream from those vanes in order to avoid disturbing the flow passing between the vanes.

In this example, one of the arms 12 of the services-passing system also includes an opening 13 for bleeding off air and situated in the proximity of its leading edge 14.

The inside of the arm 12 also contains the inlet of a duct 15 that forms a scoop for bleeding air from the secondary stream F2 and connected to the opening 13. The duct 15 passes inside the arm 12 and passes through the shroud 11 so as to take cold air bled from the secondary stream F2 and convey it to cooling devices. Preferably, but not necessarily, the air bled off by the duct 15 is used by means 16 for cooling an outer casing 17 of the low-pressure turbine 7 in order to regulate the clearance between the casing 17 and the rotor blades of the turbine 7. The duct 15 then extends in an inter-passage space, also referred to as the "core zone", that lies between the primary flow passage and the secondary flow passage 9 and that contains equipment forming part of the engine.

Figure 2:
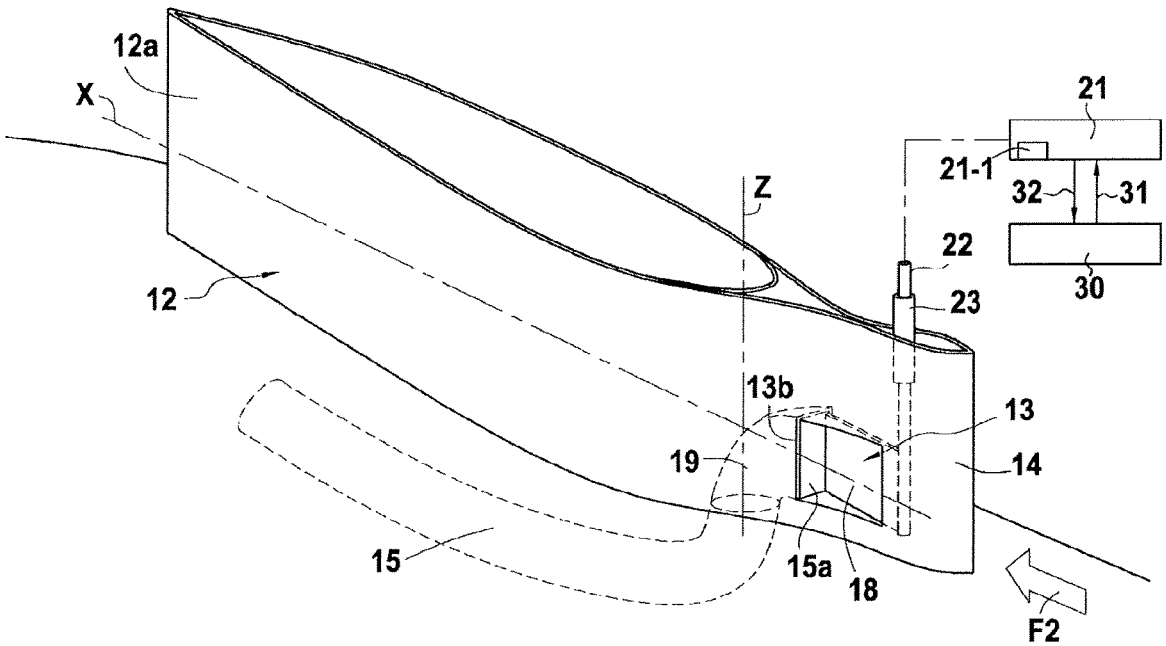
FIG. 2 is a perspective view of a services-passing arm associated with an embodiment of the air flow regulator system.

In an example shown in FIG. 2, the services-passing arm 12 includes a main portion 12*a* for passing services and presenting a shape that is streamlined in a longitudinal direction X that is substantially parallel to the flow of the secondary stream F2 in the vicinity of the arm 12. This main portion 12*a* crosses the flow passage 9 for the secondary stream F2 and is of substantially constant shape between the two shrouds 10 and 11 in the direction in which the arm Z extends, which direction is substantially radial and perpendicular to the longitudinal direction X.

The opening 13 has a movable flap 18 for shutting the duct 15, the flap being pivotable about an axis parallel to the radial direction Z at the corresponding upstream edge of the opening. The shape of the movable shutter flap 18 of the duct 15 corresponds to the surface of the plate that has been cut away so as to form the opening 13.

Under such circumstances, the air bleed duct 15 has an inlet 15*a* that is connected to the downstream edge 13*b* of the opening 13 so as to form an air bleed scoop 19.

The air bleed scoop 19 is thus associated with the movable flap 18, which flap can pivot about its pivot axis between an open position and a closed position in order to regulate the flow of air entering into the scoop 19. Depending on the degree of cooling that is desired, the air bled by the scoop 19 can then be distributed to various zones of the turbine engine 1, e.g. around the casing of the low-pressure turbine 7, by means of an air distributor manifold.

Figure 4:
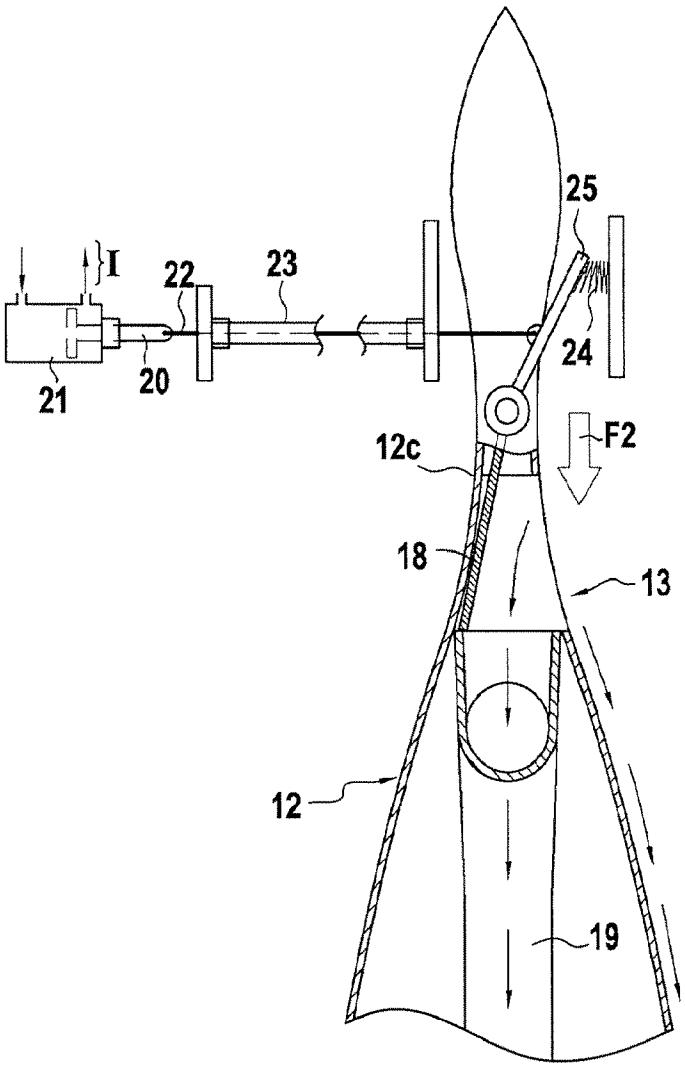
FIG. 4 is a view from above of the services-passing arm associated with an embodiment of an air flow regulator system, the system presenting a movable flap in the open position for a nominal situation.
Figure 3:
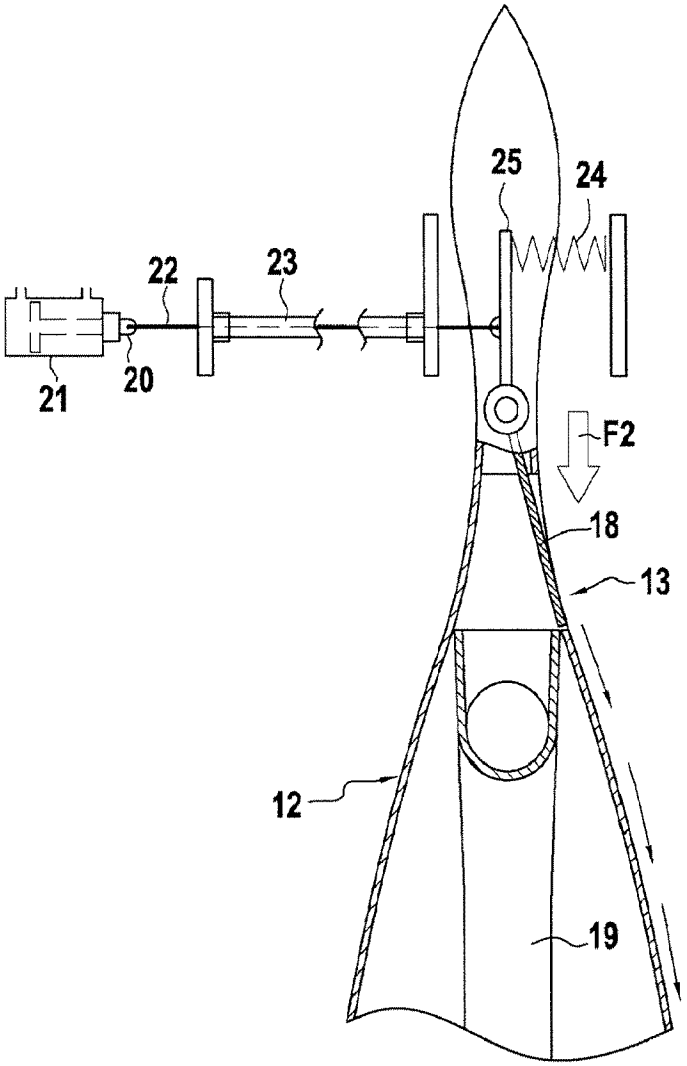
FIG. 3 is a view from above of the services-passing arm associated with an embodiment of the air flow regulator system, the system presenting a movable flap in the closed position for a nominal situation.

An embodiment of the mechanism for actuating the movable flap 18 is shown in FIGS. 3 and 4, which are views from above relative to the arm 12.

In these figures, and also in the preceding figures, the movable flap 18 is actuated by a moving force from a movable drive rod 20 of an actuator 21 when the actuator is powered. More precisely, the drive rod 20 of the actuator 21 serves to deliver a movement force between a first position corresponding to the closed position of the movable flap 18 and a second position corresponding to the open position of the movable flap 18.

By way of example, the actuator 21 may be an electric actuator, a pneumatic actuator, or indeed a hydraulic actuator. Nevertheless, a necessary condition for performing an integrity test as described in detail below is that the actuator 21 must present behavior that is astable when it is no longer powered. By "astable" behavior, it should be understood that the position of the drive rod of the actuator is determined solely by forces external to the actuator that act on the rod.

The movement of the drive rod 20 of the actuator 21 is controlled by an electronic computer 30, referenced in FIG. 2, and configured:

- to control the supply of power to the actuator 21 (arrow 31) in such a manner as to control movement of its rod 20. By way of example, if the actuator 21 is an electric actuator, the electronic computer 30 may cause an electric switch connecting the actuator 21 to an electrical power supply to open or to close; and
- to estimate the movement of the drive rod 20 of the actuator 21 on the basis of measurements returned (arrow 32) by at least one position sensor 21-1 measuring the position of the rod 20.

The movement force is transmitted from the drive rod 20 to the movable flap 18 by means of a push-pull cable 22 that connects together, directly or indirectly, the drive rod 20 of the actuator 21 and the movable flap 18. The push-pull cable 22 may optionally be arranged in a sheath 23 providing it with guidance and protection.

In general manner, the movable flap 18 may be actuated by any suitable actuator 21 that possesses a movable drive element 20 connected to the push-pull cable 22 and that is suitable for transmitting its movement force to the movable flap 18. The movement of the movable drive element 20 is not necessarily exclusively movement in translation. It is possible to envisage a movable drive element 20 that is in the form of a rotary arm.

Furthermore, the term "push-pull" cable is used broadly in the present description to cover any driving connection enabling both thrust and traction to be transmitted between the movable drive element 20 and the movable flap 18. This therefore covers not only in conventional manner a cable that can slide by way of example in a guide and protection sheath, but equally well other driving connections such as in particular a linkage comprising hinged rods or an association of one or more rods and one or more cables. The actuator 21 and the electronic computer 30 may be positioned by way of example in a zone of space close to the fan 2, such as a compartment in the nacelle around the fan 2. Such a zone is particularly advantageous since it is a cool zone suitable for receiving electrical equipment. In the example shown, the sheath 23 of the cable 22 then passes from the nacelle of the fan 2 to the arm 12.

It is possible for the actuator 21 to be located elsewhere, in some other space of the nacelle situated radially outside the secondary passage 9, or indeed in the space between passages if the problem of ensuring that the actuator 21 is not subjected to excessive temperatures is overcome.

In the absence of force being transmitted by the cable 22 to the movable flap 18, a safety spring 24 is configured to move the movable flap 18 towards its closed position so as to put the movable flap 18 into a safe position, commonly referred to as its "fail-safe" position.

Thus, in order to ensure that the movable flap 18 can occupy its safe position, the spring 24 is dimensioned so as to be capable of moving the movable flap 18 and also the elements to which the movable flap 18 is connected for moving it, in particular the cable 22 and the drive rod 20 of the actuator 21.

The air bleed scoop 19, the movable flap 18, the safety spring 24, the push-pull cable 22, and the actuator 21 controlled by electronic computer 30 thus together form a system for regulating air flow in the turbine engine.

FIGS. 3 and 4 show situations relating to nominal operation of this air flow regulator system. As can be seen in the figures:

- in the closed position (FIG. 3), the movable flap 18 shuts the opening 13 in the arm 12, thus preventing any entry of the secondary stream F2 into the air bleed scoop 19. The air of the secondary stream F2 then flows along the arm 12, this air flow being represented by successive single-headed arrows. In nominal operation, as shown in this figure, the closed position of the movable flap 18 is guaranteed by the safety spring 24, which is in an extended position. The actuator 21 is no longer powered and its drive rod 20 is retraced into the first position. Retraction of the drive rod 20 of the actuator 12 is indirectly the result of the return force exerted by the spring 24 on the movable flap 18, this force being transmitted to the drive rod 20 via the push-pull cable 22;
- in the open position (FIG. 4), the movable flap 18 is held in abutment against a wall 12*c* of the arm away from the opening 13 in the arm 12, which is then no longer shut, thus enabling a portion of the secondary stream F2 to enter into the air bleed scoop 19. Air from the secondary stream F2 then flows in part into the scoop 19 and in part along the arm 12, this air flow being represented by successive single-headed arrows. In nominal operation, as shown in this figure, the open position of the movable flap 18 is provided by the actuator 21 which is then powered, this power being represented by two single-headed arrows I. More precisely, the rod 20 of the actuator 21 is moved to its position extended towards the second position and the force that it exerts is transmitted via the push-pull cable 22 to the movable flap 18. The safety spring 24 is then in its compressed position as a result of the force applied by the rod 20 on the movable flap 18.

In the example shown in the figures, the movable flap 18 is actuated by a lever 25 arranged at the top of the arm 12 and outside the secondary passage, the lever 25 being capable of pivoting about the pivot axis of rotation of the movable flap 18. The lever is also connected firstly to the cable 22 and secondly to the safety spring 24, these both being arranged above the arm 12. The respective interconnections between the drive rod 20 of the actuator 21 and the movable flap 18, and between the movable flap 18 and the spring 24 are thus implemented in this example indirectly by means of the lever 25. Nevertheless, it is also possible for direct interconnections to be made with the movable flap 18, i.e. without necessarily using the lever 25, these figures serving merely as illustrative example for the embodiments described below.

Figure 6:
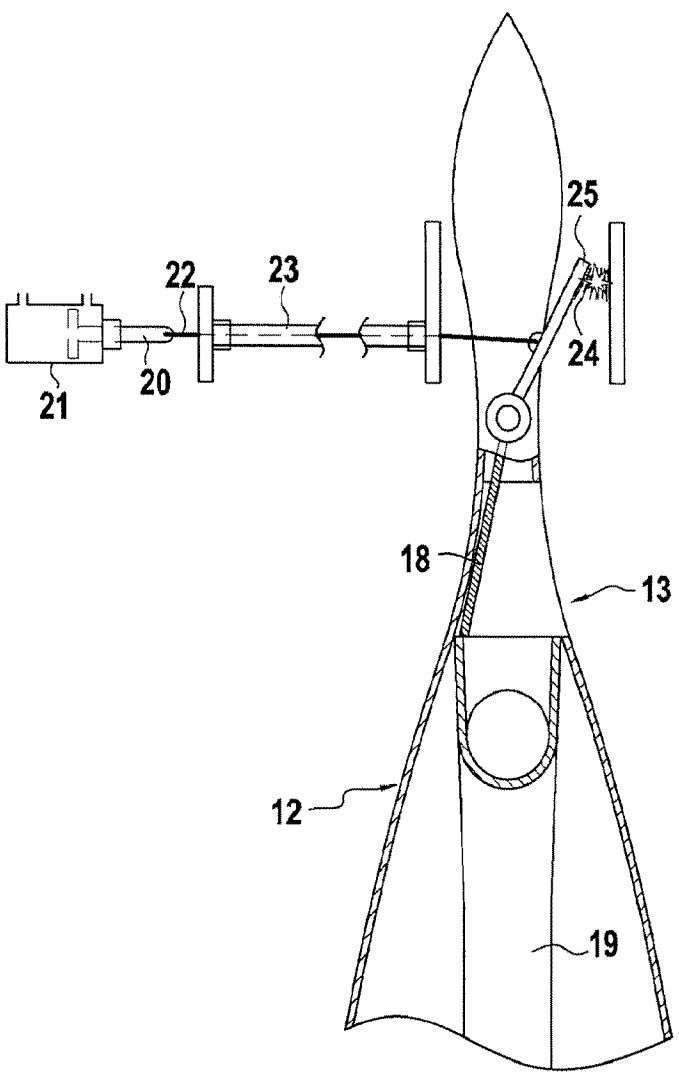
FIG. 6 is a view from above of the services-passing arm associated with an embodiment of an air flow regulator system, the system presenting a second failure situation.
Figure 5:
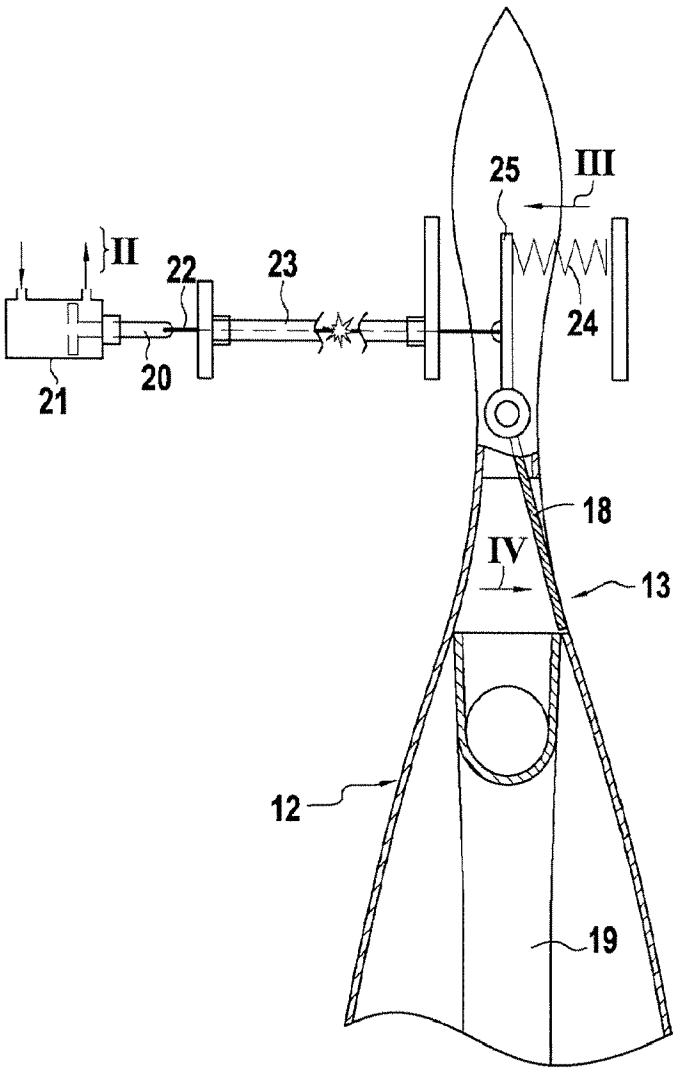
FIG. 5 is a view from above of the services-passing arm associated with an embodiment of an air flow regulator system, the system presenting a first failure situation.

FIGS. 5 and 6 use the same numerical references as FIGS. 3 and 4, these figures showing the same elements in the same three-dimensional configuration as those described above.

FIG. 5 shows a first failure situation that can occur in the system for regulating the air flow in the turbine engine 1. This first situation corresponds to a mechanical break in the push-pull cable 22, thus preventing any movement force being transmitted from the drive rod 20 of the actuator 21 to the movable flap 18.

In this example, the actuator 21 is powered, this power supply being represented by two single-headed arrows II so as to move its drive rod 20 towards the second position, i.e. towards the extended position needed by the rod 20 for opening the movable flap 18. Nevertheless, the break in the cable 22 means the movement force can no longer be transmitted from the rod 20 of the actuator 21 in order to move the movable flap 18 towards its open position. Consequently, the safety spring 24 remains in or returns to its extended position, exerting a return force (single-headed arrow III) that holds the movable flap 18 in the closed position or that moves the movable flap 18 into that position (single-headed arrow IV), i.e. into the "fail-safe" position, as contrasted to the expected open position.

Furthermore, since the actuator 21 presents astable behavior when it is no longer powered, the position of the rod 20 is determined solely by forces external to the actuator 21 and acting on the rod 20. As a result of the break in the cable 22, the rod 20 of the actuator 21 is no longer subjected to force from the cable and therefore remains in its extended position.

FIG. 6 shows a second failure situation that can occur in the system for regulating air flow in the turbine engine 1. This second situation corresponds to a mechanical break in the safety spring 24.

In this example, the actuator 21 has previously been powered so as to move its drive rod 20 towards the second position, i.e. towards the extended position of the rod 20 in order to open the movable flap 18. This time the movement of the rod 20 takes place in nominal manner so that the movable flap 18 is moved into its open position. Breakage of the spring 24 might occur equally well before or after the movement of the rod 20. In other words, the mechanical break of the safety spring 24 could take place equally well while the movable flap 18 was still in its closed position.

Furthermore, in the situation when mechanical breakage of the push-pull cable 22 is combined with mechanical breakage of the safety spring 24, the movable flap 18 would be subjected solely to the aerodynamic forces of the secondary stream F2, which would then push the flap towards its open position. The method of testing the integrity of the system applies equally well in this very unlikely situation of combined breaks, and makes it possible to detect the occurrence of the failure in the same manner as in the second failure situation shown in FIG. 6.

After the drive rod 20 has been moved to its second position, and in order to verify the integrity of the air flow regulator system, the actuator 21 is no longer powered. When the integrity of the air flow regulator system is good, the spring 24 pushes back the movable flap 18 to its closed (fail-safe) position and pushes back the rod 20 of the actuator 12 to its closed position, i.e. its retraced position.

However, breakage of the spring 24 prevents the return force from acting on the movable flap 18 and indirectly from acting on the rod 20 of the actuator 21.

The movable flap 18 then remains in the open position, mainly as a result of the aerodynamic forces exerted on the flap by the secondary stream F2. Furthermore, since the actuator 21 is no longer powered, the position of the rod 20 is determined solely by the forces external to the actuator 21 that act on the rod 20. Since the rod 20 is connected to the movable flap 18 via the push-pull cable 22, it is thus the position of the movable flap 18 that controls the position of the rod. Since the movable flap 18 remains in the open position, the rod 20 of the actuator remains in the extended position.

The air stream entering into the turbine engine 1 is no longer regulated, nor is the movable flap 18 put into its safe position.

Figure 7:
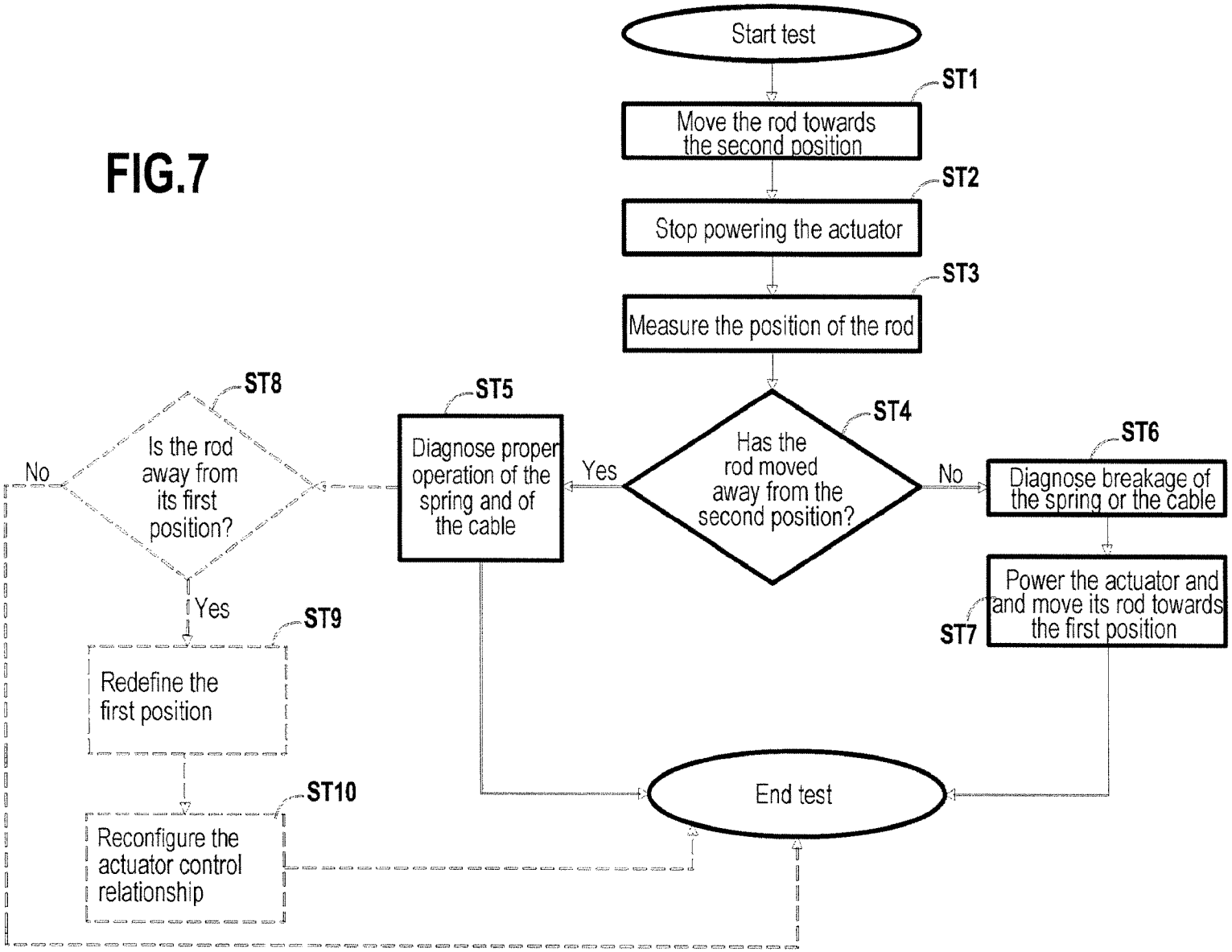
FIG. 7 is a flow chart showing the various steps of testing the integrity of the air flow regulator system in various implementations.

To detect the possible occurrence of the above-described faults, and consequently provide a response to such situations, the electronic computer 30 then causes a test to be executed for testing the integrity of the air flow regulator system, with the various steps of the method being shown in FIG. 7.

The integrity of the air flow regulator system is verified as follows.

Firstly, the electronic computer 30 powers the actuator 21 to cause it to move its drive rod 20 towards the second position (step ST1), for the desired purpose of indirectly moving the movable flap 18 into the open position. For this step, any absence or presence of a failure in the mechanical drive system formed by the cable 22 and the spring 24 for moving the movable flap 18 has not yet been determined. Thus, although moving the rod 20 towards its second position is proposed to move the movable flap 18 into the open position, in practice such opening might or might not take place in the steps of the test as described below, it being possible that such a situation results from a mechanical break in the cable 22.

Once the drive rod 20 has been moved into the second position, the electronic computer 30 switches off the power supply to the actuator 21 (step ST2). By way of example, if the actuator 21 is an electric actuator, the electronic computer 30 may cause the electric switch connecting the actuator 21 to the electrical power supply of the aircraft to open. As a result of switching off the power supply, the drive rod 20 of the actuator 21 can no longer transmit movement force to the movable flap 18.

Thereafter, the computer 30 causes the position of the rod 20 to be measured by at least one position sensor (step ST3). The electronic computer 30 receives the measurement it requested and it compares it with the value for the second position. In this way, the electronic computer 30 determines that the drive rod 20 has indeed moved or has not moved at all relative to the second position (step ST4), which second position is assumed to enable the movable flap 18 to open.

In a nominal situation, the electronic computer 30 determines that the rod 20 has moved relative to the second position, representing proper operation of the push-pull cable 22 and of the safety spring 24. Specifically, assuming proper integrity for the cable 22 and the spring 24, as set out above, turning off the power supply to the actuator 21 results in no movement force being transmitted from the rod 20 to the movable flap 18. The spring 24 then exerts a return force on the movable flap 18, with the return force then being transmitted indirectly to the drive rod 20 via the push-pull cable 22. The rod 20 is thus observed to move.

Thus, as a result of detecting movement of the rod 20, the electronic computer 30 deduces that the push-pull cable 22 and the safety spring 24 are operating properly (step ST5).

On the contrary, if as a result of switching off the power supply to the actuator 21, the computer 30 determines that there is no movement of the rod 20 relative to the second position, the computer then deduces inability (e.g. breakage) of the spring 24 or breakage of the cable 22 (step ST6).

As a result of this diagnosis, the computer 30 then causes the actuator 21 to be powered so as to move its rod 20 towards the first position (step ST7).

Advantageously, this movement of the rod 20 serves to accommodate any failure situation. Specifically, in the event of the cable 22 breaking, corresponding to the first failure situation in FIG. 5, the second position of the rod 20 does not enable the movable flap 18 to be controlled, so extending the rod in this way is unnecessary. Furthermore, the safety spring 24 then puts the movable flap 18 into the fail-safe position by moving the flap towards its closed position. In the event of the safety spring 24 breaking, corresponding to the second failure situation of FIG. 6, the safety spring 24 is no longer capable of putting the movable flap 18 into the fail-safe position. Consequently, moving the rod 20 towards the first position serves to cause the movable flap 18 to take up its safe position, by moving the flap towards its closed position by means of a traction force communicated to the movable flap 18 by the cable 22 from the actuator 21.

Advantageously, the above-described test of the integrity of the air regulator system may be executed periodically, with that periodicity being selected as a function of the acceptable length of dormancy for a failure, which itself may be determined, by way of example, by analyzing a failure tree.

By way of example, such an integrity test may be performed on the ground before starting the turbine engine 1, or indeed after stopping it. Performing this test during one of the above-mentioned stages in the life of the engine is particularly advantageous, since during those stages there is no particular need for the air flow regulator system. In particular, there is no flow of air entering into the scoop 19, regardless of the position of the movable flap 18. It is then possible to manipulate the movable flap 18 without any consequence for the engine.

It is also possible to perform this test at other times in the life cycle of the engine, so long as the consequences on the operation of the engine due to variations in the air flows while the movable flap 18 is being manipulated are deemed to be acceptable.

Furthermore, an optional implementation shown in dashed lines can be implemented after diagnosing proper operation of the cable 22 and of the spring 24 (step ST5).

Commonly, the electronic computer 30 includes in memory a pre-stored control relationship for the drive rod 20 of the actuator 21, this relationship modeling in particular the movement of the rod 20 between the first position and the second position. During aging of the mechanical elements of the air flow regulator system, e.g. the cable 22 and the spring 24, variations in clearance may appear between those various elements, leading to the movement of the movable flap 18 being controlled less accurately.

In order to mitigate this drawback, in an implementation, after diagnosing proper operation of the cable 22 and of the spring 24 (step ST5), the computer 30 compares the measured position of the rod 20 with the value of the first position, corresponding to the extended position of the rod 20 for moving the flap into its closed position. Thus, the electronic computer 30 determines a possible movement of the drive rod 20 possibly all the way to the first position. More precisely the electronic computer 30 determines a potential difference between the position of the rod 20 and the first position (step ST8). If this difference is zero, then the test ends.

Conversely, when the position of the drive rod 20 differs from the first position, the electronic computer 30 then redefines the first position by allocating to the first position the measured position of the drive rod (step ST9).

Finally, on the basis of the redefined first position, the electronic computer 30 reconfigures its control relationship for the movement of the rod 20 of the actuator 21 (step ST10). Advantageously, this serves to refine the accuracy with which the movement of the flap 18 is controlled by the computer 30.

If the consequences for the engine due to the variations in the air flow rate that result from manipulating the movable flap 18 are acceptable, and as a function of the accuracy required for the manipulation, this implementation can be performed at the beginning of the stage of flight of the aircraft.

Performing this test during this stage of life is particularly advantageous, since it then makes it possible when reconfiguring of the control relationship for the rod 20 of the actuator 21 to take account of the effects of thermal deformation acting on the dynamics of the air flow regulator system.

In order to enable the control relationship to be reconfigured accurately during this stage in the life of the engine, the actuator 21 may be made so as to filter the vibration associated with the stage of flight, thereby limiting unwanted movements of its actuator rod 20.

The implementations described above are described for a particular example of a cooling system in a turbine engine. Nevertheless, these implementations are applicable to any air flow regulator system, and more generally to any system for regulating a flow of fluid (gas or liquid) in a turbine engine. For example, for regulating an airflow, it is possible to envisage applying the method to an air-oil heat exchanger (also known as an air-cooled oil cooler (ACOC)) fed with air coming from the secondary stream, to controlling the clearance that exists in a low- or high-pressure turbine, to a fan air valve (FAV) for the pre-cooler, or indeed to a ventilation scoop.

As mentioned above, the regulation may apply to a flow of fluid in general. When regulating a liquid flow, it is possible to envisage making provision to apply the integrity test to a regulator system comprising a valve in which the pivoting shutter member in the form of a movable flap, e.g. of the butterfly type, is controlled by an actuator via a push-pull cable connecting the drive rod of the actuator to the rotary shaft of the shutter member. By way of example, the fluid-passing duct associated with the valve may be connected to a heat exchanger in such a manner that regulating the flow of liquid serves to vary the heat exchange taking place within the heat exchanger between the liquid and some other fluid. The valve may have a failsafe position that is open or closed, obtained by means of a mechanical return spring or indeed by return means resulting from the pivot axis of the movable flap (butterfly) of the valve having an off-center position.

The movable flap (generally a disk) of a butterfly type valve conventionally presents a pivot axis that is centered, i.e. that extends along a diameter of the flap. It is known that an off-center axis serves to unbalance the pressure forces from the fluid that act on the flap on either side of the axis, thereby exerting a turning torque on the flap. This torque may be used to generate the return force for bringing the movable flap of the valve back into a failsafe position in the absence of any drive force being exerted on the flap, in particular in the event of a break in the push-pull cable that drives turning of the flap.

This provision makes it possible to omit a mechanical return spring while still obtaining the failsafe position. The safety return means provided by the off-center axis of the flap can nevertheless become dysfunctional, even in the absence of mechanical breakage. For example, the shaft of the flap may seize in an angular position that is different from the failsafe position in a manner capable of generating an opposing torque that is large enough to prevent the above-mentioned return force returning the flap into the failsafe position in the absence of force being transmitted by the cable to the flap.

Furthermore, the term "closed" position of the movable flap for shutting the fluid-passing duct 15 should be understood as a position in which the duct is at least partially closed by the flap.

The invention claimed is:

1. A method of testing the integrity of a fluid flow regulator system for a turbine engine, the system comprising:

a fluid-passing duct associated with a movable flap for shutting the duct and suitable for pivoting about an axis between a closed position and an open position;

an actuator having a movable drive element, said drive element being suitable for delivering a movement force between a first position corresponding to the closed position of the movable flap and a second position corresponding to the open position of the movable flap;

a push-pull cable interconnecting the drive element of the actuator and the movable flap, and suitable for transmitting a movement force to the movable flap; and safety return means exerting a return force suitable for moving the movable flap towards the closed position in the absence of force being transmitted by the cable to the movable flap;

wherein said method of testing the integrity of the system further comprises in succession:

a step of supplying power to the actuator in order to place the drive element in the second position;

a step of interrupting the supply of power to the actuator; and a step of measuring the position of the drive element.

2. The method according to claim 1, comprising:

comparing the measured position of the drive element with said second position in order to identify a movement of the drive element; and detecting an inability of the safety return means or breakage of the push-pull cable when the measured position of the drive element corresponds to said second position.

3. The method according to claim 2, wherein, after deducing the inability of the safety return means or the breakage of the push-pull cable, the method comprises supplying power to the actuator in order to place the drive element in said first position.

4. The method according to claim 1, comprising:

comparing the measured position of the drive element with said second position; and deducing integrity of the regulator system when the measured position differs from said second position.

5. The method according to claim 4, comprising, after deducing integrity of the regulator system:

comparing the measured position of the drive element with said first position; and when the position of the drive element differs from said first position:

redefining the first position by allocating the measured position of the drive element to the first position; and as a function of the redefined first position, reconfiguring a pre-stored control relationship relating to the movement of the drive element.

6. A fluid flow regulator system for a turbine engine, the system comprising:

a fluid-passing duct associated with a movable flap for shutting the duct and suitable for pivoting about an axis between a closed position and an open position;

an actuator having a movable drive element, said drive element being suitable for delivering a movement force between a first position corresponding to the closed position of the movable flap and a second position corresponding to the open position of the movable flap;

an electronic computer suitable for:

supplying power to the actuator so as to cause its drive element to be moved; and estimating the movement of the drive element from measurements returned by at least one position sensor measuring the position of that element;

a push-pull cable interconnecting the drive element of the actuator and the movable flap and suitable for transmitting a movement force to the movable flap; and safety return means exerting a return force suitable for moving the movable flap towards the closed position in the absence of force being transmitted by the cable to the movable flap;

wherein the electronic computer is configured to proceed with a test of the integrity of the system by causing the following in succession:

power to be supplied to the actuator to place the drive element in the second position;

interrupting the power supply to the actuator; and measuring the position of the drive element.

7. The system according to claim 6, wherein the electronic computer is configured:

to compare the measurement of the position of the drive element with said second position in order to identify a movement of the drive element; and to detect an inability of the safety return means or a breakage of the push-pull cable when the measured position of the drive element corresponds to said second position.

8. The system according to claim 7, wherein after deducing the inability of the safety return means or the breakage of the push-pull cable, the electronic computer is configured to supply power to the actuator so as to place the drive element in said first position.

9. The system according to claim 6, wherein the electronic computer is configured:

to compare the measured position of the drive element with said second position; and to deduce the integrity of the regulator system when the measured position differs from said second position.

10. The system according to claim 9, wherein the electronic computer is configured:

after deducing integrity of the regulator system, to compare the measured position of the actuator element with said first position; and when the position of the drive element differs from said first position:

to redefine the first position by allocating the measured position of the drive element to the first position; and as a function of the redefined first position, to reconfigure a pre-stored control relationship relating to the movement of the drive element.

11. The system according to claim 6, comprising:

an air bleed scoop constituting said fluid-passing duct; and a mechanical spring constituting said safety return means and potentially suffering a break leading to its inability to produce said return force exerted on the movable flap.

* * * * *